US005085406A

United States Patent [19]

Schmaltz

[11] Patent Number: 5,085,406

[45] Date of Patent: Feb. 4, 1992

[54] THUMB WHEEL FOR A JACK

[75] Inventor: Gary E. Schmaltz, Three Oaks, Mich.

[73] Assignee: Ausco Products, Inc., Benton Harbor, Mich.

[21] Appl. No.: 622,751

[22] Filed: Dec. 5, 1990

[51] Int. Cl.[5] ..... B66F 3/18

[52] U.S. Cl. ..... 254/103; 254/DIG. 3

[58] Field of Search ..... 81/125; 254/103, 1, 254/DIG. 3

[56] References Cited

U.S. PATENT DOCUMENTS

| | | | |
|---|---|---|---|
| 1,593,217 | 7/1926 | Lucker | 254/103 |
| 1,600,058 | 9/1926 | Morrison | 254/103 |
| 2,107,715 | 2/1938 | Runyan et al. | 254/103 |
| 2,895,363 | 7/1959 | Cox | 81/125 |
| 3,245,446 | 4/1966 | Morifuji | 81/125 |
| 3,884,282 | 5/1975 | Dobrosielski | 81/125 |
| 4,979,355 | 12/1990 | Ulevich | 81/125 |

*Primary Examiner*—Robert C. Watson

*Attorney, Agent, or Firm*—Renner, Kenner, Greiver, Bobak, Taylor & Weber

[57] ABSTRACT

A jack (11) is provided with a thumb wheel (10) preferably made of a plastic material. The jack (11) includes a side gear having an end (20) extending out of a side gear housing (18). The housing (18) has an outer peripheral lip (19) which is engaged by the thumb wheel (10). The thumb wheel (10) includes a plate (24) having an aperture (26) therein of a configuration complementary to that of the side gear end (20) so that when the thumb wheel (10) is positioned on the jack (11), the side gear end (20) will be within the aperture (26) and will rotate upon rotation of the plate (24). The thumb wheel (10) also includes a collar (30) having a plurality of slots (33) therein and a circumferential barb (31) near the end thereof. Upon installing the thumb wheel (10), the collar (30) flexes and the barb (31) snaps over and engages the lip (19) on the housing (18). The engagement is only in the axial direction such that the thumb wheel (10) will freely rotate with respect to the housing (18).

15 Claims, 2 Drawing Sheets

THUMB WHEEL FOR A JACK

TECHNICAL FIELD

This invention relates to a mechanical jack and thumb wheel assembly. More particularly, this invention relates to a thumb wheel for a screw jack. Specifically, this invention relates to a thumb wheel which is easily attachable to the side gear of a screw jack.

BACKGROUND ART

Some conventional screw jacks are provided with a thumb wheel which is attached to the side gear of the jack. The thumb wheel permits one to manually partially extend the jack without the use of the conventional handle to thereby put the screw train in compression and minimize internal rattle during stowage in a vehicle.

Such thumb wheels, universally constructed of a metallic material, require the use of a separate fastener to attach the same to the side gear. As such, the traditional thumb wheel hub must be attached to the side gear which represents a tedious and costly assembly step. Moreover, the metallic thumb wheel and additional fastener themselves add to the cost of the jack.

DISCLOSURE OF THE INVENTION

It is thus a primary object of the present invention to provide a jack and thumb wheel assembly in which the thumb wheel is inexpensive to manufacture and easy to assemble onto the jack.

It is another object of the present invention to provide a jack and thumb wheel assembly, as above, in which the thumb wheel is attached to the side gear of the jack without the need for an additional fastening device.

It is a further object of the present invention to provide a jack and thumb wheel assembly, as above, in which the thumb wheel is made of a plastic material and is thereby inexpensive to manufacture and easy to install.

These and other objects of the present invention, as well as the advantages thereof over existing prior art forms, which will become apparent from the description to follow, are accomplished by the means hereinafter described and claimed. In general, the thumb wheel according to the present invention is adapted for use with a jack having a side gear positioned within a side gear housing. The housing is provided with a peripheral lip thereon. The thumb wheel includes a plate for engaging the side gear and a collar extending outwardly from the plate. The collar is provided with a barb member which engages the peripheral lip of the side gear housing. Upon rotation of the plate, the side gear will be turned while at the same time the collar will rotate with respect to the side gear housing.

A preferred exemplary thumb wheel for a jack incorporating the concepts of the present invention is shown by way of example in the accompanying drawings without attempting to show all the various forms and modifications in which the invention might be embodied, the invention being measured by the appended claims and not by the details of the specification.

PREFERRED EMBODIMENT FOR CARRYING OUT THE INVENTION

Figure 1:
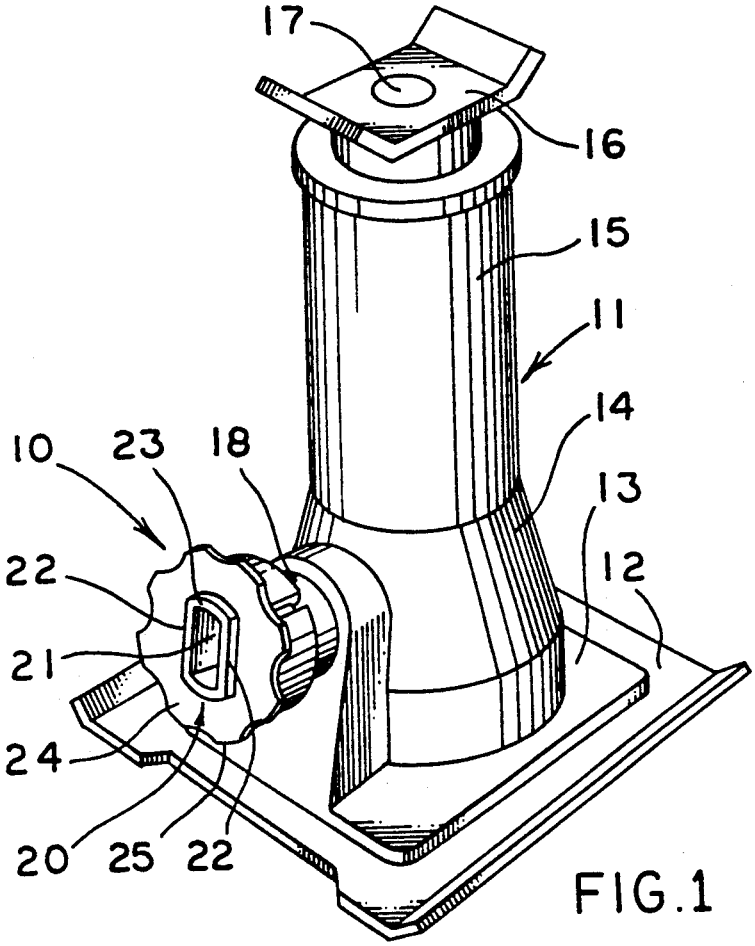
FIG. 1 is a somewhat schematic perspective view of a screw jack which is equipped with the thumb wheel according to the concept of the present invention.
Figure 2:
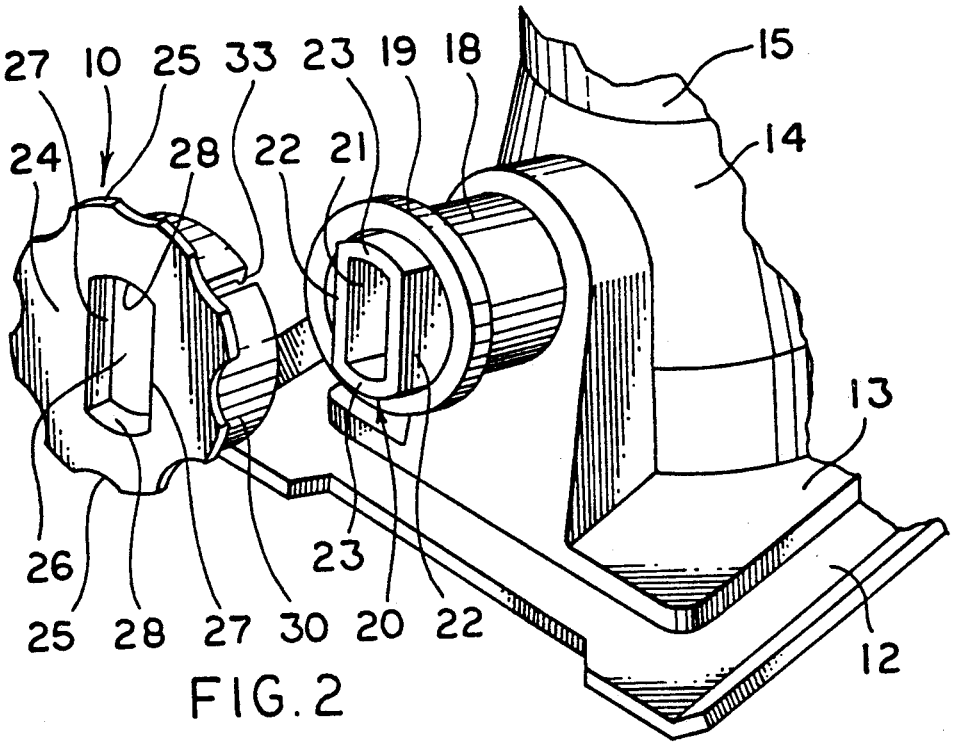
FIG. 2 is an enlarged fragmented perspective view of a portion of the screw jack shown in FIG. 1, with the thumb wheel being shown as exploded away from the jack.
Figure 3:
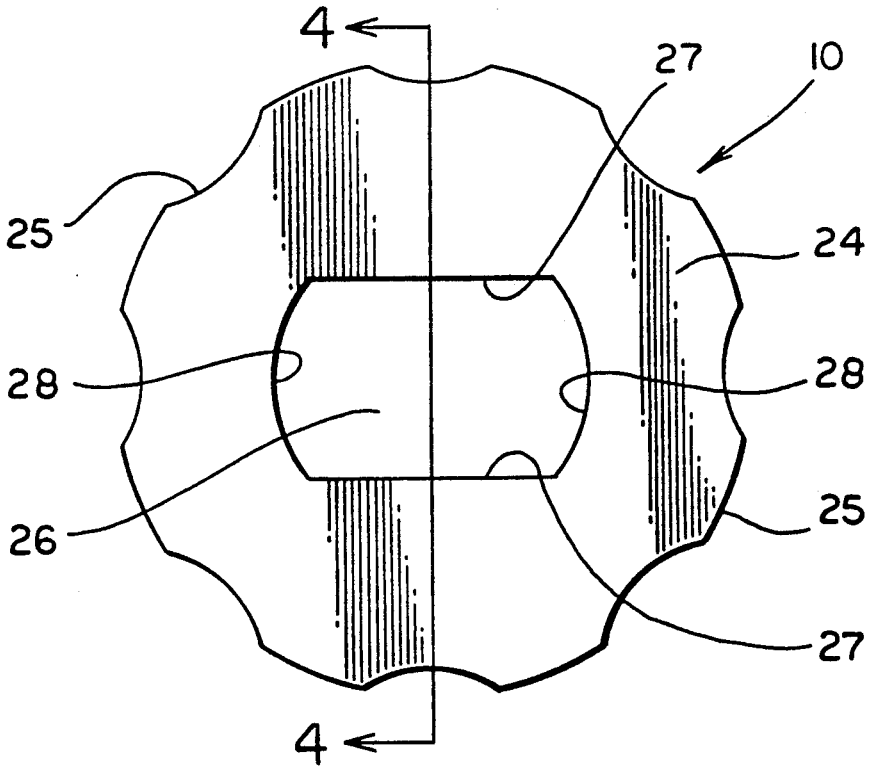
FIG. 3 is an elevational view of the thumb wheel according to the concept of the present invention.

A thumb wheel in accordance with the concepts of the present invention is indicated generally by the numeral 10 in the drawings and is adapted for use with a screw jack indicated generally by the numeral 11 in FIG. 1. Although thumb wheel 10 could be used with jacks of other configurations, jack 11, as shown, is a rather conventional screw jack and the intricacies thereof will not be described in detail but only insofar as is necessary to understand the present invention. As such, jack 11 includes a base plate 12 having a pedestal 13 thereon upon which a stand or gear housing 14 is integrally formed. A generally cylindrical screw train housing 15 extends upwardly from stand 14, and a load bearing frame 16 extends out of the top of housing 15 at the top of a jack screw 17. A side gear housing 18 extends generally laterally from stand 14 with the outer end thereof terminating with an outer peripheral lip 19 (FIG. 2). Housing 18 carries a side gear therein having an end, generally indicated by the numeral 20, extending slightly outwardly of housing 18. The end 20 of the side gear has an aperture 21 therein adapted to receive a conventional jack handle. End 20 also includes two flat sides 22 spanned by arcuate surfaces 23 and is thus configured, as will hereinafter be described, to receive thumb wheel 10.

In the normal operation of jack 11, the load bearing frame 16 is positioned under an item to be lifted, such as the frame of a vehicle, and a jack handle is inserted into aperture 21 of side gear end 20. Rotation of the side gear via the handle rotates a bottom gear within stand 14 which in turn rotates jack screw 17 in housing 15 to lift, or lower as the case may be, load bearing frame 16.

Thumb wheel 10 is provided to move an unloaded frame 16 in small increments, as might be necessary to partially extend frame 16 to put the screw train in compression thereby minimizing internal rattling when jack 11 is stored in a vehicle. Thumb wheel 10 can be conveniently and inexpensively formed of a somewhat flexible plastic material, such as polyethylene, and includes a wheel face plate 24 having a scalloped circumferential edge 25 for ease of gripping. Face plate 24 is also provided with a aperture 26 therethrough which complements the configuration of the end 20 of the side gear of jack 11. As such, aperture 26 has flat side surfaces 27 spanned by arcuate surfaces 28.

Figure 4:
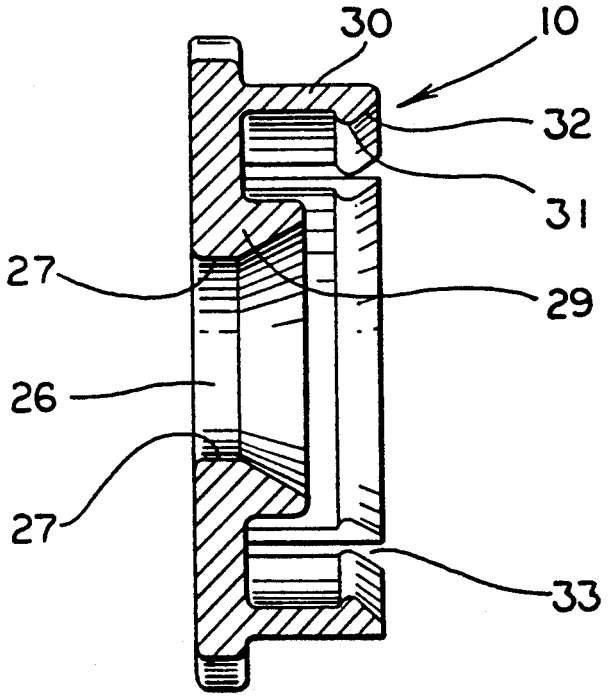
FIG. 4 is a sectional view taken substantially along line 4—4 of FIG. 3.

As shown in FIG. 4, tapered guide flanges 29 extend rearwardly from plate 24 adjacent to flat surfaces 27 of aperture 26. Also extending rearwardly from plate 24 near the periphery thereof, is a generally cylindrical collar 30. A circumferential barb member 31 extends generally radially inwardly near the end of collar 30 opposite to plate 24 and is provided with an inwardly directed bevelled surface 32. Collar 30 is also provided With a plurality of axially extending slots 33 therein. The exact number of slots 33 is not critical to this invention, with the number selected depending on the particular nature of the plastic material selected. For polyethylene, four slots 33 equally spaced at ninety degrees of each other are preferred. Slots 33 assist in the positioning of thumb wheel 10 on jack 11 in a manner now to be described.

Thumb wheel 10 can be quickly and easily assembled onto jack 11 by merely aligning aperture 26 with the end 20 of the side gear and pushing thumb wheel 10 toward end 20 and toward side gear housing 18. Precise alignment is not necessary in view of the tapered nature of guide flanges 29 which will readily allow end 20 to be received within aperture 26 and thereby be engaged by plate 24. During the time that thumb wheel 10 is being pushed onto jack 11, the outer end of collar 30 contacts lip 19 on side gear housing 18. Lip 19 thereby slides along bevelled surface 32 of barb member 31 and due to the flexible nature of collar 30, particularly in view of the presence of slots 33, collar 30 flexes outward. Continued inward pressure allows barb member 31 to snap over and thereby engage lip 19. Such engagement, however, only prohibits an easy axial movement of thumb wheel 10 with respect to housing 18 and does not prohibit the rotational movement of thumb wheel 10 with respect to housing 18, which rotational movement, of course, turns end 20 of the side gear because of its positioning within aperture 26. It should be appreciated that the internal diameter of collar 30 at the area of barb 31 should be slightly smaller than the external diameter of lip 19 so that collar 30 will readily flex over lip 19, yet not be so much smaller so as to impede the free rotation of thumb wheel 10. A thumb wheel 10, so positioned, can be readily removed from jack 11, if desired, merely by grasping and pulling wheel face plate 24 to flex collar 30 sufficiently so that barb 31 disengages lip 19 to release the axial engagement of thumb wheel 10 on housing 18.

It should thus be evident that a thumb wheel and jack assembly constructed in accordance with the present invention as herein described improves the jack art and otherwise accomplishes the objects of the present invention.

I claim:

1. A screw jack comprising a load bearing frame, a side gear housing, an end of a side gear extending outwardly from said housing, said load bearing frame moving upwardly and downwardly in response to selective rotation of said side gear end, a peripheral lip on said housing, wheel plate means for engaging said side gear end, a generally cylindrical collar extending from said wheel plate means toward said housing, and barb means positioned circumferentially near the end of said collar for engaging said peripheral lip on said housing so that rotation of said wheel plate means rotates said collar with respect to said housing and at the same time rotates said side gear end to move said load bearing frame.

2. A screw jack according to claim 1 wherein said peripheral lip on said housing is circumferential in nature and is of a diameter greater than the diameter of said barb means.

3. A screw jack according to claim 2 further comprising means on said barb means to assist said barb means in snapping over said peripheral lip.

4. A screw jack according to claim 2 further comprising slot means in said collar to facilitate flexing of said collar to enable said barb means to engage said peripheral lip of said housing.

5. A screw jack according to claim 4 wherein said slot means are axially oriented in said collar.

6. A screw jack according to claim 4 wherein said wheel plate means, said collar and said barb means are constructed of a plastic material.

7. A screw jack comprising a load bearing frame, a side gear housing, an end of a side gear extending outwardly from said housing, said load bearing frame moving upwardly and downwardly in response to selective rotation of said side gear end, a peripheral lip on said housing, wheel plate means having an aperture through which said side gear end may pass so that said wheel plate means engages said side gear end, a collar extending from said wheel plate means toward said housing, and barb means on said collar for engaging said peripheral lip on said housing so that rotation of said wheel plate means rotates said collar with respect to said housing and at the same time rotates said side gear end to move said load bearing frame.

8. A screw jack according to claim 7 further comprising means on said wheel plate means to guide said side gear end through said aperture.

9. A screw jack according to claim 7 wherein said side gear end has flat surfaces and said aperture has corresponding flat surfaces to engage said flat surfaces of said side gear end.

10. A screw jack according to claim 7 wherein said collar is cylindrical in nature and said barb means is positioned circumferentially near the end of said collar.

11. A screw jack according to claim 10 wherein said peripheral lip on said housing is circumferential in nature and is of a diameter greater than the diameter of said barb means.

12. A screw jack according to claim 11 further comprising means on said barb means to assist said barb means in snapping over said peripheral lip.

13. A screw jack according to claim 11 further comprising slot means in said collar to facilitate flexing of said collar to enable said barb means to engage said peripheral lip of said housing.

14. A screw jack according to claim 13 wherein said slot means are axially oriented in said collar.

15. A screw jack according to claim 13 wherein said wheel plate means, said collar and said barb means are constructed of a plastic material.

* * * * *